US005940652A

United States Patent [19]

Hirakawa

[11] Patent Number: 5,940,652

[45] Date of Patent: Aug. 17, 1999

[54] IMAGE FORMING APPARATUS

[75] Inventor: Tatsuji Hirakawa, Aichi-Ken, Japan

[73] Assignee: Minolta Co., Ltd., Osaka, Japan

[21] Appl. No.: 09/018,430

[22] Filed: Feb. 4, 1998

[30] Foreign Application Priority Data

Feb. 5, 1997 [JP] Japan ..... 9-022535

[51] Int. Cl.[6] ..... G03G 15/00

[52] U.S. Cl. ..... 399/8; 399/81; 395/113; 340/825.06; 340/825.15

[58] Field of Search ..... 399/1, 8, 80, 81, 399/82, 83, 84, 85; 379/100, 102, 106; 382/135, 181; 395/113, 280; 340/825.06, 825.07, 825.15

[56] References Cited

U.S. PATENT DOCUMENTS 4,991,972 2/1991 Ikenoue et al. ..... 395/113

5,146,269 9/1992 Shimizu et al. ..... 399/8

5,491,535 2/1996 Hirata et al. ..... 399/8

*Primary Examiner*—Arthur T. Grimley

*Assistant Examiner*—Hoan Tran

*Attorney, Agent, or Firm*—Sidley & Austin

[57] ABSTRACT

An image forming apparatus provided with a memory which stores predetermined data, receiver which receives data via a communications line, a first modifier which changes predetermined data based on data received by the receiver, a second modifier which changes predetermined data based on data input from an operation panel provided on the apparatus, wherein modification of predetermined data by the first modifier is allowed and modification of predetermined data by the second modifier is prohibited insofar as data can be transmitted via the communications line.

20 Claims, 5 Drawing Sheets

FIG. 3
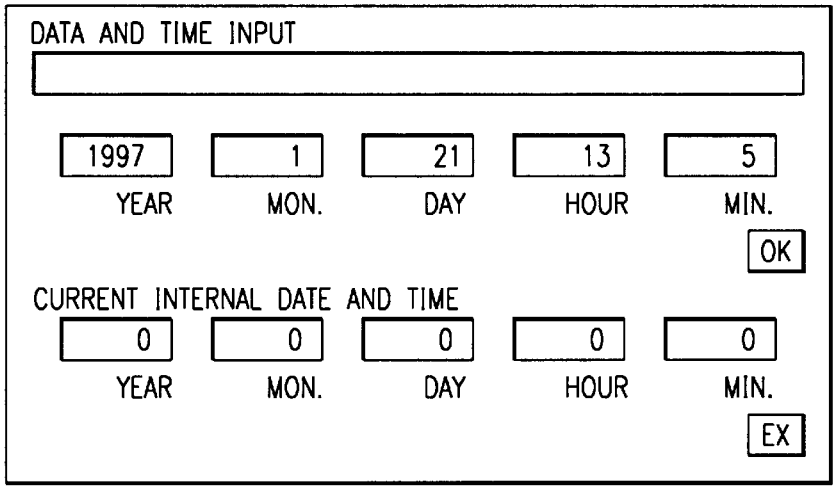
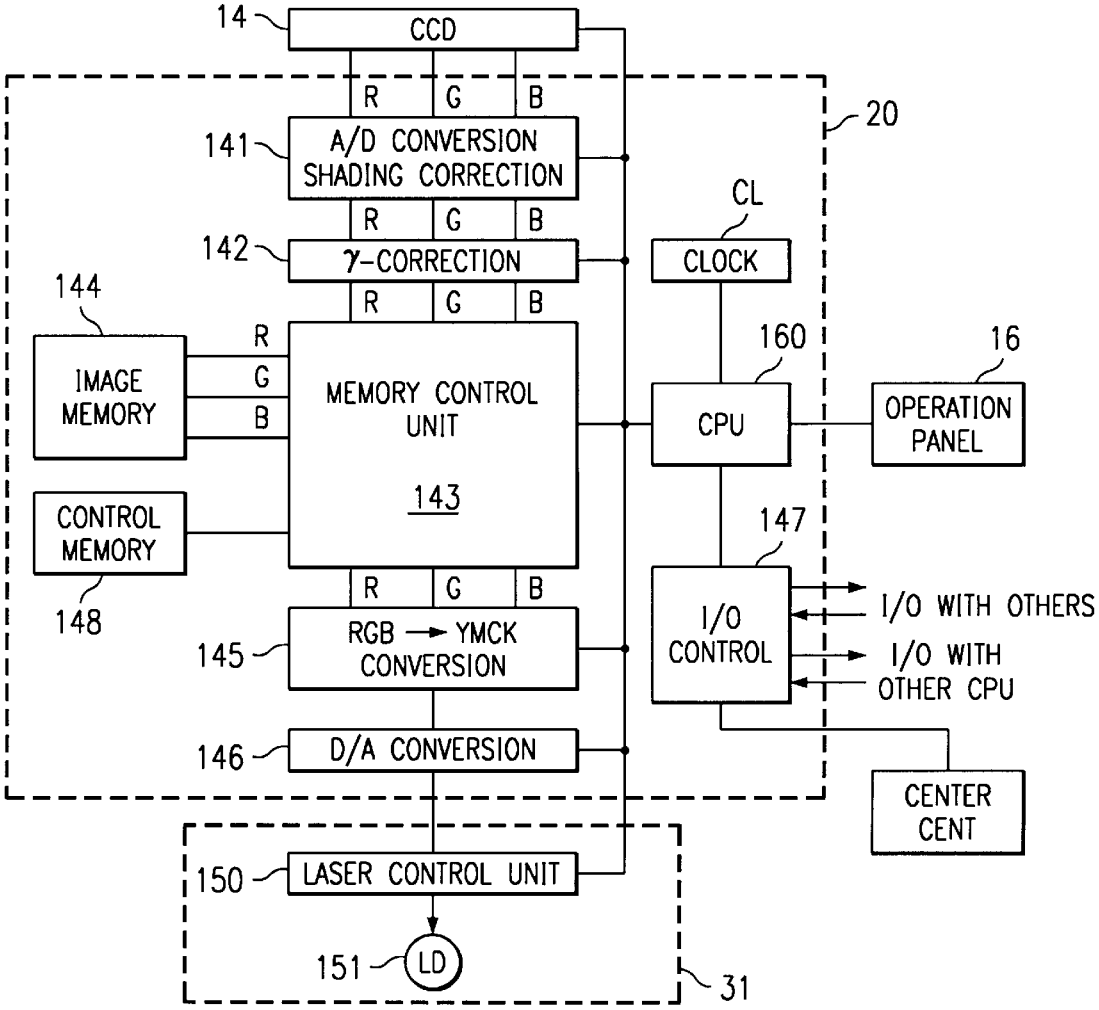
FIG. 4

IMAGE FORMING APPARATUS

This application is based on application No. Hei 9-22535 filed in Japan, the content of which is hereby incorporated by reference.

BACKGROUND OF THE INVENTION

1. Field of the Invention

The present invention relates to an image forming apparatus capable of receiving data through a communications line.

2. Description of the Related Art

Image forming apparatuses such as copiers and the like are widely used today.

Copiers are installed and used in various types of companies and offices as well as so-called convenience stores and the like.

Many companies and offices have multiple copiers, and even many franchise-related convenience stores have installed multiple copiers.

In the aforesaid situations, there are times when, for example, specific information must be collected from a plurality of copiers, or conversely information must be input to a plurality of copiers. More specifically, consider collecting and totaling at one location the copy number of a plurality of copiers, clearing the copy number counters of a plurality of copiers from one location, and managing from one location various maintenance information such as parts replacement and repair and the like for a plurality of copiers.

Each such copier is used independently without communications lines. Accordingly, such copiers are constructed so as to allow information input and output using an operation panel or the like. Even when copiers are linked to a communications line, there is the possibility that each copier contains information unique to that particular copier, such that even though information may be input and output via the communications line, such information is normally input and output using an operation means provided on each copier.

On the other hand, when managing as a group a plurality of copiers linked by a communications line, there is the possibility of generating input errors when data input from each copier is subjected to modification. Disadvantages arise when information containing input errors are data that may produce a large variance in result. Furthermore, data such as may generate skewing of sequential data between copiers as in clock data may be managed in one location to modify or revise data simultaneously in all copiers from the single location. Complex or troublesome data may also be managed in batches so as to be periodically revised in each copier, and in this instance also may be managed in one location to modify or revise data simultaneously in all copiers from the single location.

Therefore, the operational states and functional states and the like of a plurality of copiers can be managed in one location. Such copiers are provided functions to communicate with a predetermined location such as a management center or the like.

Copiers provided with communications functions are subject to the following disadvantages. Even copiers provided with communications functions are typically also provided with data input/output means so as to be capable of inputting and modifying data locally in the manner of conventional copiers. On the other hand, copiers provided with communications functions are constructed so as to be capable of inputting and modifying the same data from a predetermined location using the communications functions.

In copiers provided with communications functions, data can be modified using the specific data input means of each copier even though specific important data are input to each copier from a predetermined location as in the case of centralized management. As a result, disadvantages arise in that such dual input means hinder centralized management.

For example, specific data under centralized management such as date and time of tracking materials of document creation to be printed on copy sheets can be disadvantageously modified locally on each copier even though the data has been modified in a batch from the management center.

SUMMARY OF THE INVENTION

An object of the present invention is to eliminate the previously mentioned disadvantages.

A further object of the present invention is to provide an image forming apparatus that does not hinder batch management of copiers.

Another object of the present invention is to provide an image forming apparatus that restricts data input/output and data modification from an operation panel.

Still another object of the present invention is to provide an image forming apparatus that does not allow modification of data input via a communications line from the local copier under predetermined conditions.

These and other objects are attained by providing an image forming apparatus comprising a memory to store predetermined data, first and second modifier to modify predetermined data in the memory, and controller to permit modification of the predetermined data by the first modifier and prohibit modification of the predetermined data by the second modifier under predetermined conditions.

The aforesaid objects of the present invention are further attained by providing an image forming apparatus comprising a memory to store predetermined data, receiver to receive data through a communications line, first modifier to modify predetermined data based on data received by the receiver, second modifier to modify predetermined data based on data input from an operation panel provided on the apparatus, and controller to permit modification of predetermined data by the first modifier and prohibit modification of predetermined data by the second modifier under conditions allowing reception of data through the communications line.

BRIEF DESCRIPTION OF THE DRAWINGS

These and other objects and features of the present invention will become apparent from the following description of the preferred embodiments thereof taken in conjunction with the accompanying drawings, in which:

FIG. 3 illustrates the date and time screen displayed on the operation panel;

FIG. 4 is a block diagram of the electrical circuits of the digital color copier;

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
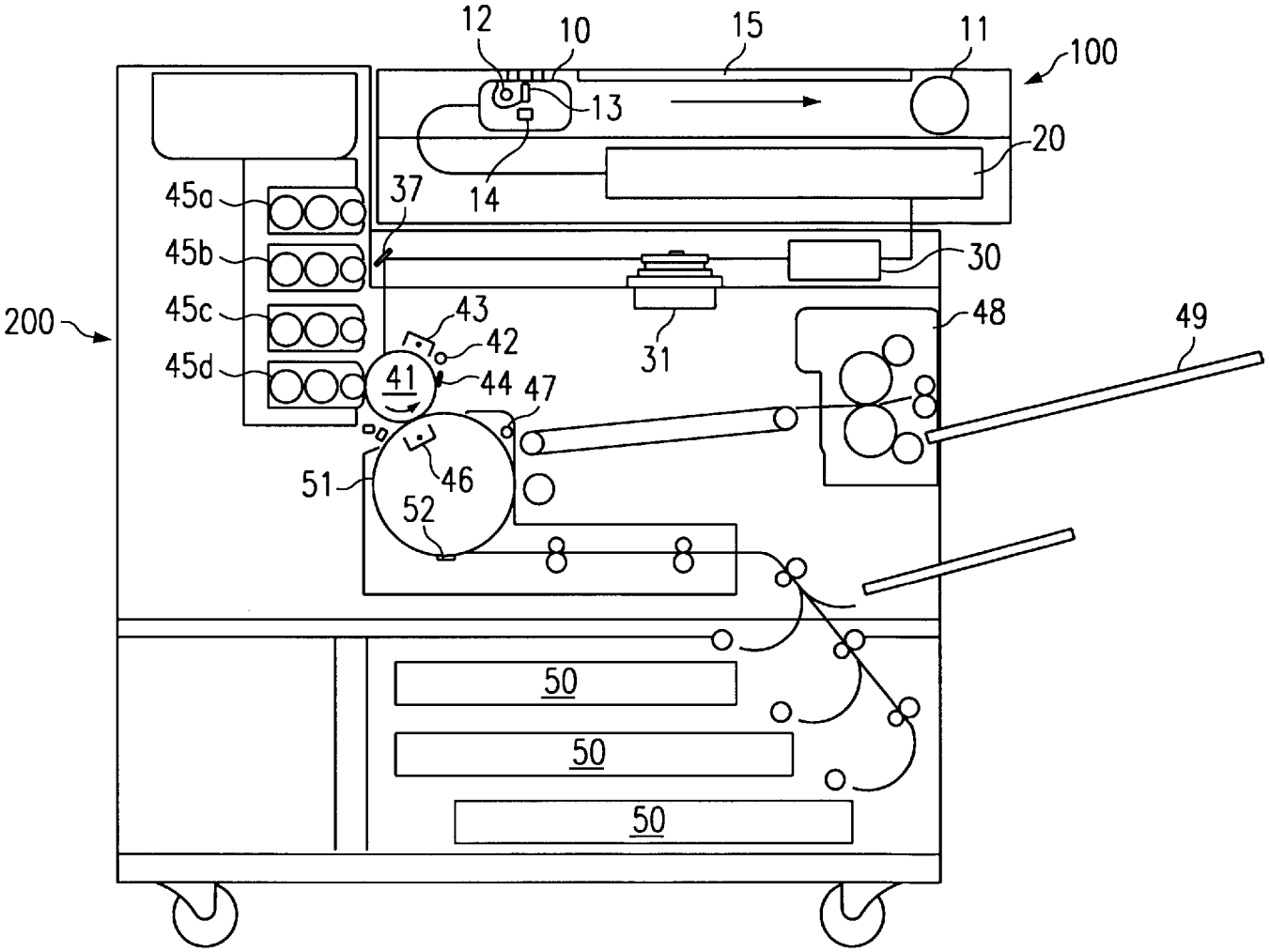
FIG. 1 briefly shows the construction of a digital color copying apparatus of the present invention.

FIG. 1 shows the general construction of a digital color copier of the present invention. This digital color copier broadly comprises an image reading unit 100 to read documents, and copying unit 200 to reproduce the read image data.

Image reading unit 100 comprises a scanner 10, exposure lamp 12 to illuminate a document, rod lens array 13 to condense the reflected light from an illuminated document, and a sealed-type charge-coupled device (CCD) color image sensor 14 to convert condensed light to electrical signals. Scanner 10 is driven by a scanner motor 11 so as to move in the arrow direction (subscan direction) to scan a document placed on document platen 15 when reading a document. Image sensor 14 converts the reflected light from the document surface to electrical signals of three colors red (R), green (G), blue (B). The R, G, B electrical signals are converted to 8-bit gradient data by image signal processing unit 20, and subsequently stored in synchronizing buffer memory 30.

In copying unit 200, a printhead 31 generates laser diode drive signals by digital-to-analog (A/D) conversion of input gradient signals, and emits a laser beam based on the drive signal. The laser beam irradiates the surface of a rotatable photosensitive drum 41 via a reflecting mirror 37. The surface of photosensitive drum 41 is irradiated by eraser lamp and uniformly charged by charger 43 prior to the optical exposure of each formation of toner image cyan (C), magenta (M), yellow (Y), and black (Bk). When the surface of photosensitive drum 41 is subjected to optical exposure in the aforesaid condition, an electrostatic latent image of a document is formed on the surface of photosensitive drum 41. Thereafter, only one among the cyan (C), magenta (M), yellow (Y) black (Bk) toner developing devices 45*a*~45*d* is selected to develop the electrostatic latent image formed on the surface of photosensitive drum 41. A copy sheet of a desired size is fed from one of three paper cassettes 50. The leading edge of a fed copy sheet is chucked by a chucking mechanism 52 on transfer drum 51, so as to be held on the drum 51 without dislocation during the image transfer. A developed toner image is transferred to the copy sheet wrapped around transfer drum 51 via a transfer charger 46.

The aforesaid transfer process is sequentially repeated for the four color cyan (C), magenta (M), yellow (Y), black (Bk). At this time, scanner 10 repeats the scanning operation synchronously with the operation of photosensitive drum 41 and transfer drum 51. Thereafter, the copy sheet is separated from the transfer drum 51 via the operation of a separation member 47, and passes through fixing device 48 which fuses the toner image to the sheet which is then ejected to a discharge tray 49.

Figure 2:
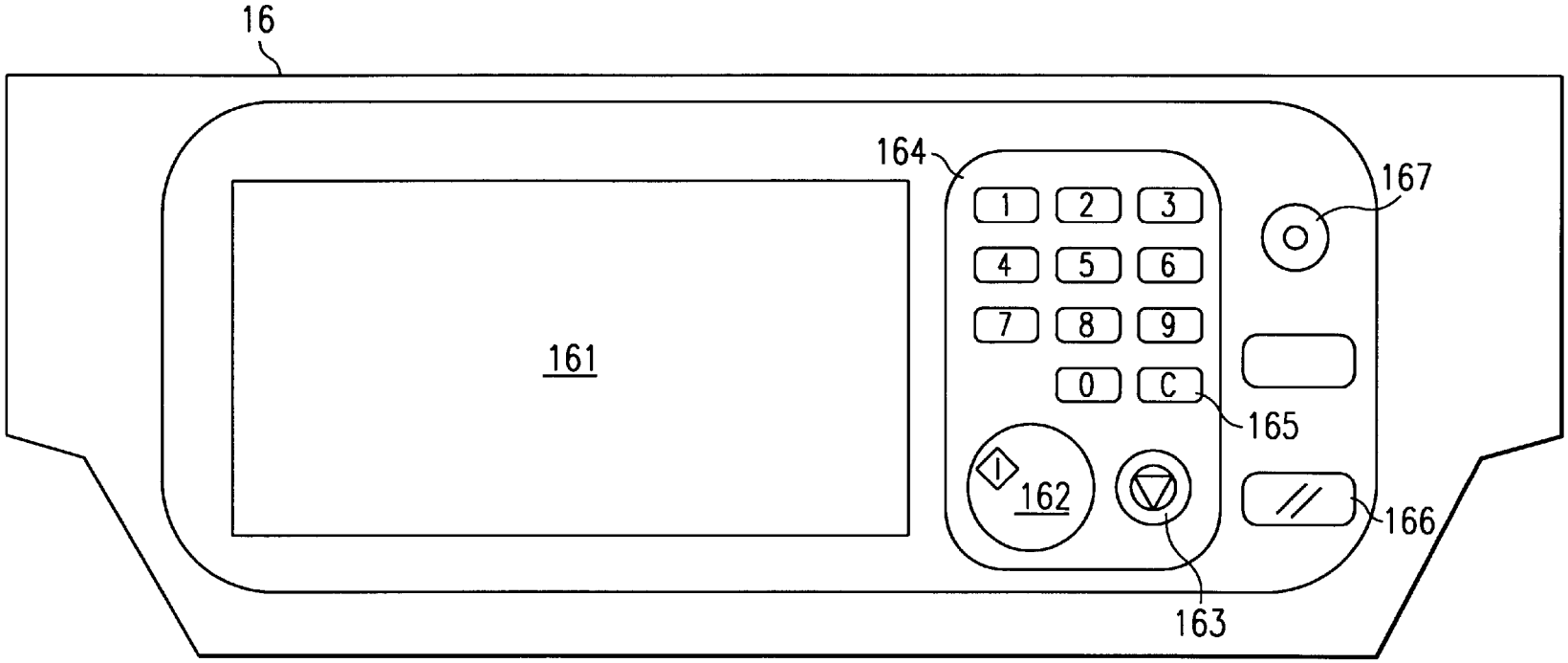
FIG. 2 is a plan view of an operation panel of the digital color copying apparatus.

FIG. 2 shows a plan view of operation panel 16. Operation panel 16 is provided with a display 161, print key 162 to start a copy operation, stop key 163 to stop a copy operation, ten-key pad 164 to set the copy number and the like, clear key 165 to clear numerical values set by the ten-key pad, panel reset key 166 to reset the panel, and time setting key 167 described later.

Display 161 is a touch-panel type liquid crystal display, which allows input and setting of the copy mode, copy number and the like by pressing the various setting and selection buttons displayed on the display panel as well as input of settings and the like via the ten-key pad 164.

Display 161 displays the copy mode, copy number and the like set by the user.

This copying apparatus is provided with q clock CL (refer to FIG. 4) described later. The current date and time in this copying apparatus can be displayed on display 161 via time setting key 167. In this display state, the date and time can be updated by operating the ten-key pad 164 as described later. This update is accepted only under conditions which are described later.

FIG. 3 shows an example of a screen displayed on display 161 via the operation of time setting key 167. In this example, the date and time displayed in the top level have been changed by input from the ten-key pad, and the date and time displayed in the bottom level show the current internal values. When the [OK] button is pressed on the screen in this state, the modified date and time displayed in the top level is displayed in the internal date and time windows in the bottom level, and the current date and time is changed to the displayed values. Then, the date and time modification process ends when the [Ex] button is pressed on the screen.

FIG. 4 is a block diagram of the electrical circuits of the image signal processing unit 20 and the like of a digital color copier. The RGB image data of a document read by CCD color image sensor 14 are subjected to analog-to-digital (A/D) conversion and shading correction in the preprocessing unit 141 within image signal processing unit 20, and thereafter subjected to predetermined gradient correction in γ-correction unit 142. Gradient-corrected data are temporarily stored in image memory 144 via memory control unit 143. Two-dimensional addresses including an x-coordinate (main scan direction) and y-coordinate (sub-scan direction) of a document are set in image memory 144, and the RGB image data and 8-bit attribute data are stored for each pixel.

Image data are read out to color conversion unit 145 with a timing matching the operation timing of each color in the image forming unit. In color conversion unit 145, the RGB image data read out from image memory 144 are converted to 8-bit gradient data of either cyan (C), magenta (M), yellow (Y), or black (Bk), and output. Color-converted data are then converted to analog signals in D/A conversion unit 146. Laser control unit 150 in printhead 31 generates laser drive signals based on the analog signals output from D/A conversion unit 146 so as to drive laser diode 151.

The information relating to various copying conditions set from operation panel 16 by a user is stored in control memory 148. Central processing unit (CPU) 160 reads the information stored in control memory 148, and executes control sequences for the read signal processing unit 20 and printhead 31 based on the read data. Other input controls during copy execution and communication controls with other CPUs are executed via input/output control integrated circuit (IC) 147. The operation panel 16 is also connected to CPU 160. Input/output control IC 147 is connected via communications lines such as telephone lines or the like to, for example, the computer of a central management facility CENT such as a copier management center in a company or office, management center which mainly manages a plurality of franchise stores (hereinafter referred to as "center") or the like.

Figure 5:
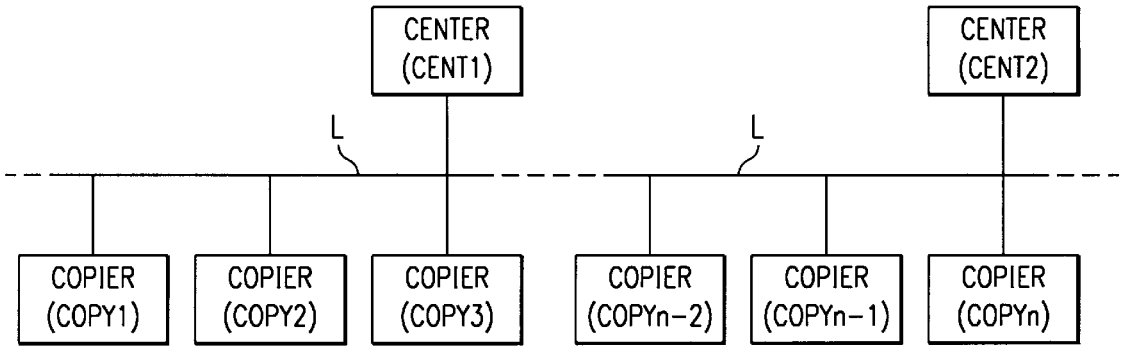
FIG. 5 shows the copier group connected to central management centers via communications lines.

FIG. 5 shows the connection state via communications lines. In FIG. 5, COPY1~COPYn refer to the aforesaid plurality of digital color copiers. Copiers of specific groups of the aforesaid copiers are connected to center CENT (CENT1) via communications line L, and copiers of other groups are connected to center CENT (CENT2) via communications line L.

The clock CL is connected to CPU 160 shown in FIG. 4. The current date and time are displayed on display 161 via the operation of date/time setting key 167 by clock CL.

CPU 160 also controls the general operation of the copier. Each center CENT can transmit predetermined data suitable for central management (e.g., in this instance, currently correct date and time data, threshold data, and telephone numbers) to each copier.

Threshold data are used by the preventive maintenance counter and jam counter. That is, if the preventive maintenance counter value attains a threshold value, a parts replacement request is transmitted to the center. Similarly, when the jam counter value attains a threshold value, a maintenance request including parts replacement is transmitted to the center.

Telephone numbers are used by the supervisor to telephone the center.

The data updating process executed by CPU 160 shown in FIG. 4 is described below.

Figure 6:
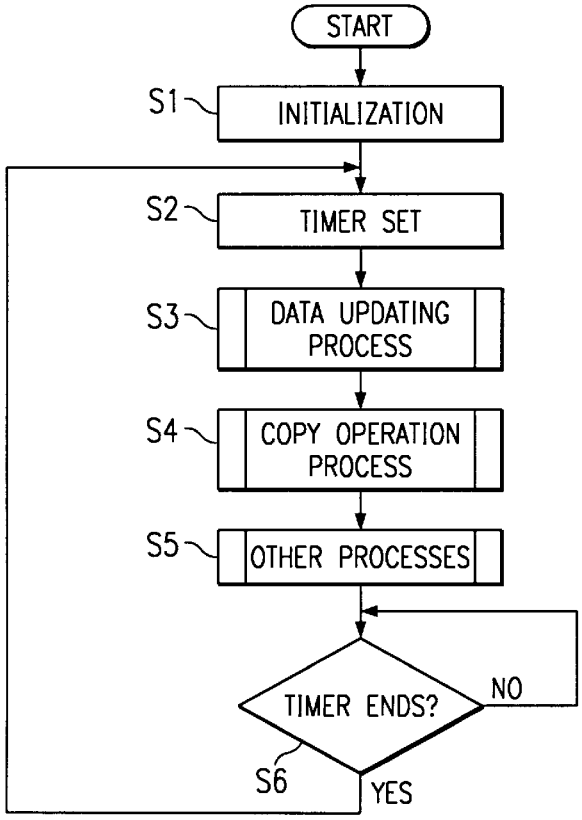
FIG. 6 is a flow chart of the main routine of the central processing unit (CPU)

FIG. 6 is a flow chart showing the main routine of CPU 160. One subroutine of this main routine is the data updating process.

As shown in FIG. 6, CPU executes initialization when the program starts, and an internal timer is started (step S1 and S2). Thereafter, the data updating process, copy operation process, and other processes are sequentially executed (steps S3, S4, S5), and the end of the internal timer is awaited in step S6, whereupon the routine returns to step S2.

Figure 7:
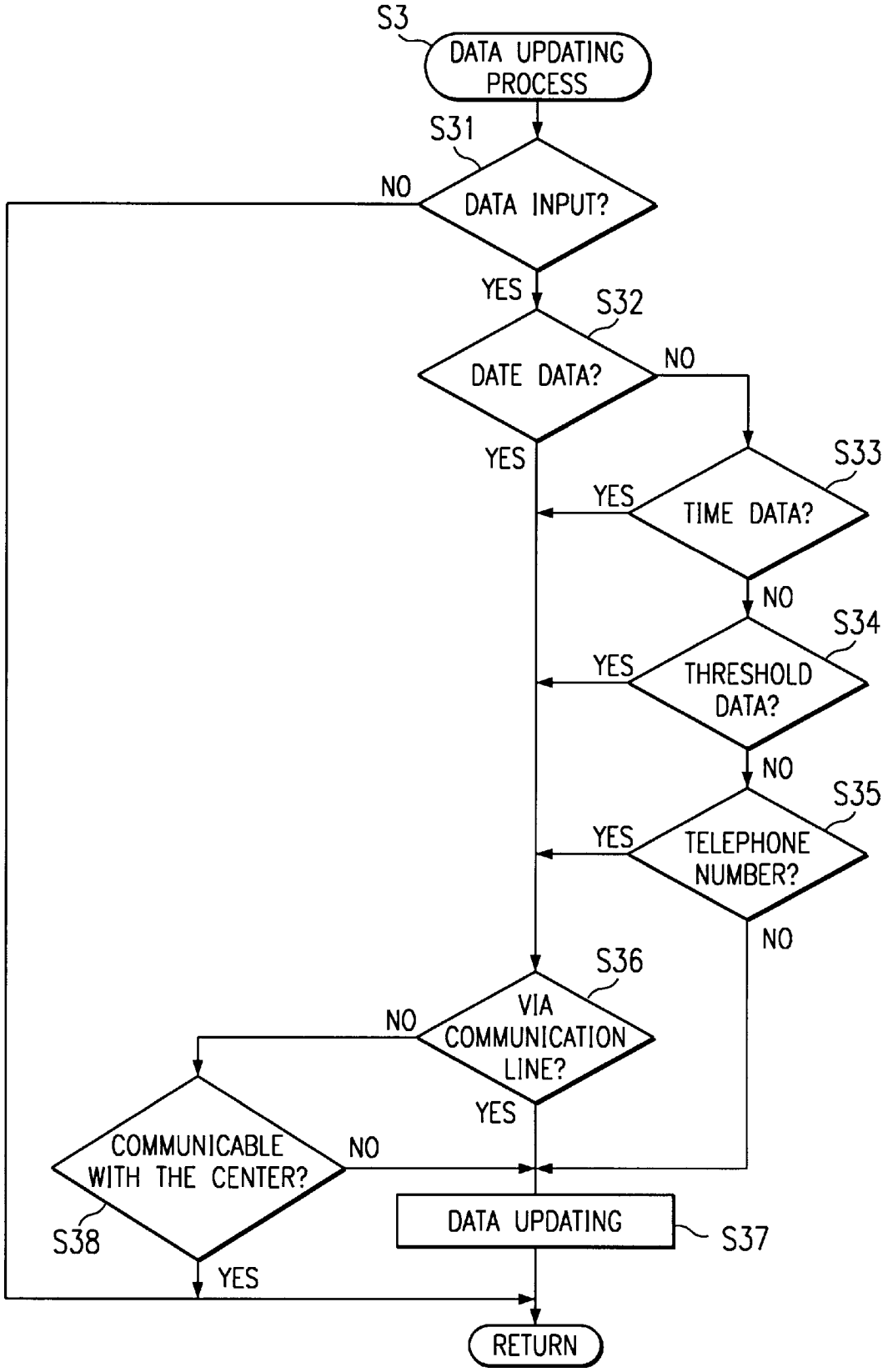
FIG. 7 is a flow chart of the data modification process routine.

FIG. 7 is a flow chart of the data updating process. In the data updating process of step S3 of the main routine, first, a check is made to determine whether or not data have been input to the device (S31). If data have not been input, the subroutine returns to the main routine. When data have been input, a determination is made as to whether the input data are date and time data, threshold data, or telephone number data (S32~S35). When the input data are none of the aforesaid data types, data are updated based on the input data (S37). When the reply to the query of steps S32~S35 is YES, a determination is made as to whether or not the data have been input via the communications line (S36). If the data have been input via the communications line, the internal copier data are updated in accordance with the input data (S37).

On the other hand, if the data have not been input via the communications line, i.e., if the data have been input from operation panel 16 of the copier, the routine advances to step S38. In step S38 a check is made to determine whether or not the copier is able to communicate with the center. When the reply to the query of step S38 is NO, the internal copier data are updated in accordance with the input data. When the reply to the query of step S38 is YES, however, the routine returns without data updating.

That is, the internal data of the copier is updated even when the input data are date data, time data, threshold data, or telephone number data insofar as the copier cannot communicate with the center. Data are not updated when the input data have not been transmitted via the communications line and the copier is able to communicate with the center.

After data have been input via the communications line, changing the date and time data on the copier side via the operation panel 16 is prohibited insofar as the copier is connected to and able to communicate with the center CENT.

In this example, once a copier is connected to and able to communicate with the center CENT, updating of date and time data and the like via the operation panel 16 of the copier is prohibited even though date and time data have not once been received from the center CENT. Normally, when a copier is connected to the center via a communications line, date and time data and the like will be quickly transmitted from the center to the copier to update the date and time data in the copier.

When a copier cannot communicate with the center because either the copier or the center have not yet been connected to the communications line, it is permitted to update the date and time data and the like on the copier side.

The date and time data and the like are printed on copy sheets in the copy operation process (step S4) of the main routine.

In the aforesaid copier, accurate date and time data, threshold data, and telephone number data may be entered in the copier using the communications line from the center that manages the copier. This process eliminates the trouble of inputting and updating date and time data, threshold data, and telephone number date to the copier, and prevents data discrepancies among the copiers.

Furthermore, when correct date and time data have been input to the copier from the center, it is by design subsequently prohibited to update the same data on the copier side, which is safer than allowing the data to be updated or corrupted on the copier side.

Printing of date and time data and the like transmitted from the center on copy sheets prevents counterfeiting of currencies, stock certificates and other negotiable securities on the copier, and provides tracking material for securities crimes such as forgery of currency or stock certificates.

When a date and time data have not yet even once been received by the copier from the center even though the copier can communicate with the center, the same data can be updated on the copier side, and after the date and time data and the like have once been received by the copier from the center, the date and time data, threshold data, and telephone data cannot be updated on the copier side, and a process such as [Have date and time data, threshold data, and telephone number data been received from the Center?] may be substituted for the process of step S38.

Although the aforesaid example has been described in terms of date and time data, threshold data, and telephone data as the specific data transmitted from the center to each copier, it is to be noted that other data (e.g., copy number, user name, department, maintenance information, maintenance record, various internal settings, priority sequence of internal settings, serial number of the copier and the like) may be used.

The copying apparatus of the present invention may be provided with a means to print predetermined data on copy sheets.

When the present invention is provided with the means to print data, examples of the predetermined data include current date and time data that can be used to prevent counterfeiting of currencies, stock certificates and other negotiable securities on the copier, and provide tracking material for securities crimes such as forgery of currency or stock certificates.

Copiers used to counterfeit currency and the like are typically full color copiers.

The present copying apparatus of the present invention uses a communications line from a specific location to input accurate predetermined data in each copier under the management of the specific location. As a result, the trouble of inputting and updating data to each copier is eliminated, and data discrepancies among copiers is prevented.

When predetermined data are input to each copier via a communications line, modifying the predetermined data using the data input means of the local copier is prohibited. Therefore, the present invention is by design safer in preventing data modification and data corruption on the copier side.

As described above, the present invention is a copying apparatus provided with a data input means to input predetermined data, and receives the predetermined data via a communications line to update the predetermined data based on the received data, and the copying apparatus is safer inasmuch as the data are input from a communications line and modification and corruption of the data is prevented on the copier side.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus, comprising:

a memory which stores predetermined data;

first and second modification means for modifying the predetermined data in the memory; and control means for permitting modification of the predetermined data by said first modification means and for prohibiting modification of the predetermined data by said second modification means under a predetermined condition.

2. An image forming apparatus according to claim 1, further comprising:

receiving means for receiving data through a communication line; and inputting means for inputting data.

3. An image forming apparatus according to claim 2, wherein said first modification means modifies the predetermined data based on data which is received by said receiving means, and said second modification means modifies the predetermined data based on data inputted said inputting means.

4. An image forming apparatus according to claim 3, wherein said inputting means is an operation panel furnished on the apparatus.

5. An image forming apparatus according to claim 3, wherein said predetermined condition is a condition which allows a communication through the communication line.

6. An image forming apparatus according to claim 3, wherein said predetermined condition is a condition after data have been modified by said first modification means.

7. An image forming apparatus according to claim 3, wherein said predetermined data is date data.

8. An image forming apparatus according to claim 3, wherein said predetermined data is time data.

9. An image forming apparatus according to claim 3, wherein said predetermined data is maintenance data which will be used for maintenance of the apparatus.

10. An image forming apparatus according to claim 3, wherein said predetermined data is telephone number.

11. An image forming apparatus according to claim 3, further comprising print means for forming an image of the data on a sheet.

12. An image forming system including an image forming apparatus and a managing apparatus, both of which are connected through a communication line, said system comprising:

first modification means for modifying predetermined data stored in said image forming apparatus based on data sent from said managing apparatus;

second modification means for modifying the predetermined data stored in said image forming apparatus based on data inputted from said image forming apparatus; and control means for permitting modification of the predetermined data by said first modification means and for prohibiting modification of the predetermined data by said second modification means under a predetermined condition.

13. An image forming system according to claim 12, wherein said second modification means includes an operation panel furnished on the image forming apparatus.

14. An image forming system according to claim 12, wherein said predetermined condition is a condition after the predetermined data have been modified by said first modification means.

15. An image forming system according to claim 12, wherein said predetermined data is date data.

16. An image forming system according to claim 12, wherein said predetermined data is time data.

17. An image forming system including an image forming apparatus and a managing apparatus, both of which are connected through a communication line, said system comprising:

first modification means for modifying predetermined data stored in said image forming apparatus based on data sent from said managing apparatus;

second modification means for modifying the predetermined data stored in said image forming apparatus based on data inputted by an operator at an operation panel on the image forming apparatus; and control means for permitting modification of the predetermined data by said first modification means and for prohibiting modification of the predetermined data by said second modification means under a predetermined condition.

18. The image forming system of claim 17 wherein said predetermined condition is the condition existing after the predetermined data have been modified by said first modification means.

19. The image forming system of claim 17 wherein the control means permits modification of the predetermined data by said second modification means when no predetermined data is stored in the image forming apparatus.

20. The image forming system of claim 17 wherein the control means permits modification of the predetermined data by said second modification means when the communication line between said image forming apparatus and said managing apparatus is nonfunctional.

* * * * *

UNITED STATES PATENT AND TRADEMARK OFFICE

CERTIFICATE OF CORRECTION

PATENT NO. : 5,940,652

DATED : August 17, 1999

INVENTOR(S) : Hirakawa

It is certified that error appears in the above-identified patent and that said Letters Patent is hereby corrected as shown below:

Column 1, line 1 and
On the Title Page, [54], delete "IMAGE FORMING APPARATUS" and insert --IMAGE FORMING APPRATUS WITH MULTIPLE DATA INPUTS--.

Column 7, line 47, delete "inputted said" and insert --inputted by said--.

Column 8, line 2, delete "is telephone" and insert --is a telephone--.

Column 8, line 50, delete "The" and insert --An--.

Column 8, line 54, delete "The" and insert --An--.

Column 8, line 59, delete "The" and insert --An--.

Signed and Sealed this

Eighteenth Day of January, 2000

*Attest:*

Q. TODD DICKINSON

*Attesting Officer*

*Commissioner of Patents and Trademarks*